US010028048B2

(12) United States Patent
Ozawa

(10) Patent No.: US 10,028,048 B2
(45) Date of Patent: Jul. 17, 2018

(54) HEADPHONES

(71) Applicant: AUDIO-TECHNICA CORPORATION, Machida-shi, Tokyo (JP)

(72) Inventor: Hiromichi Ozawa, Machida (JP)

(73) Assignee: AUDIO-TECHNICA CORPORATION, Machida-shi, Tokyo (JP)

( * ) Notice: Subject to any disclaimer, the term of this patent is extended or adjusted under 35 U.S.C. 154(b) by 0 days.

(21) Appl. No.: 15/428,733

(22) Filed: Feb. 9, 2017

(65) Prior Publication Data

US 2017/0257690 A1 Sep. 7, 2017

(30) Foreign Application Priority Data

Mar. 1, 2016 (JP) ..... 2016-038864

(51) Int. Cl.
*H04R 25/00* (2006.01)
*H04R 1/10* (2006.01)
*H04R 1/28* (2006.01)

(52) U.S. Cl.
CPC ..... *H04R 1/1008* (2013.01); *H04R 1/2819* (2013.01); *H04R 1/1075* (2013.01)

(58) Field of Classification Search
CPC combination set(s) only.
See application file for complete search history.

(56) References Cited

U.S. PATENT DOCUMENTS 5,729,605 A * 3/1998 Bobisuthi ..... H04R 1/1041 379/430

FOREIGN PATENT DOCUMENTS

JP 5253072 B2 7/2013

* cited by examiner

*Primary Examiner* — Amir Etesam
(74) *Attorney, Agent, or Firm* — Manabu Kanesaka

(57) ABSTRACT

A headphone includes a baffle plate, a driver unit attached to the baffle plate, a housing forming a back cavity at a front side of the baffle plate and the driver unit, and an ear pad attached to a peripheral edge portion of the baffle plate at a front side and forming the front cavity at the front side of the baffle plate, and the baffle plate includes at least one through hole that allows the back cavity and the front cavity to acoustically communicate with each other. The sound wave emitted from the driver unit to the back cavity passes through the through hole and cancels a low-frequency range sound wave of a sound wave emitted from the driver unit to the front cavity, so that sound quality in a low-frequency range is improved.

4 Claims, 2 Drawing Sheets

HEADPHONES

RELATED APPLICATIONS

The present application is based on, and claims priority from, Japanese Application No. JP2016-038864 filed Mar. 1, 2016, the disclosure of which is hereby incorporated by reference herein in its entirety.

BACKGROUND OF THE INVENTION

Field of the Invention

The present invention relates to headphones, specifically relates to a headphone that facilitates adjustment of sound quality in a low-frequency range without impairing the sound quality in all frequency ranges.

Description of the Related Art

FIG. 3 illustrates a sectional view of conventional sealed-type headphones disclosed in a patent document, such as Japanese Patent No. 5253072 B2. In FIG. 3, a baffle plate 2 is fit in an open end portion of a dish-shaped housing 20, and a driver unit 3 is fit into an opening formed in the baffle plate 2. As is well-known, the driver unit 3 has nearly the same configuration as a speaker unit. That is, although not illustrated, the driver unit 3 includes a magnetic circuit portion including such as a yoke, a magnet, a pole piece; a diaphragm; and a voice coil fixed to the diaphragm and disposed in a magnetic gap formed in the magnetic circuit portion.

A front side of the driver unit 3 is a surface on which the diaphragm is disposed (the lower side in FIG. 3). The housing 20 covers and seals a back side of the baffle plate 2 and a back side of the driver unit 3. A back cavity 4 having an appropriate volume is formed between an inner surface of the housing 20 and a plane defined by the back surfaces of the baffle plate 2 and the driver unit 3.

Further, a ring-shaped ear pad 5 is fixed to an outer periphery on a front side of the baffle plate 2. A space surrounded by the ear pad 5 forms a front cavity 6. When a user wears the headphones, the ear pad 5 is pressed against the side of the head of the user, and an ear of the user is accommodated in the front cavity 6.

Further, in the sealed-type headphones illustrated in FIG. 3, an acoustic resistance material 7 is attached in the back cavity 4 to mainly perform adjustment of sound quality in a low-frequency range. Further, it is also effective to cover a hole 8 formed in the baffle plate 2, which allows the back cavity 4 and the front cavity 6 to communicate with each other, with a damping material, that is, an acoustic resistance material having a high acoustic resistance, as illustrated in FIG. 3.

By the way, in the conventional headphones illustrated in FIG. 3, sound waves having a reverse phase emitted to the back side of the driver unit 3 (back cavity 4) flow to the front cavity 6 passing through the hole 8 for allowing the back cavity 4 and the front cavity 6 to communicate with each other.

However, since the hole 8 is disposed close to the ear pad 5, most of the sound waves having passed through the hole 8 from the back cavity 4 flow to the front cavity 6 through the ear pad 5. Therefore, there is a problem in that low-frequency sound waves cannot sufficiently pass to the front cavity 6 and a low-frequency component fails to be effectively cancelled at the front cavity 6, and resultantly the sound quality in the low-frequency range is deteriorated.

SUMMARY OF THE INVENTION

The present invention has been made in view of the above-described point, and an objective is to provide, in headphones having a back cavity formed at a back side of a driver unit and a front cavity formed at a front side of the driver unit, a headphone in which a sound wave emitted from the driver unit to the back cavity can effectively be cancelled at the front cavity, and the sound quality in a low-frequency range can be improved.

In order to solve the problem, a headphone according to the present invention includes: a baffle plate; a driver unit attached to the baffle plate; a housing forming a back cavity at a back side of the baffle plate and the driver unit; and an ear pad attached to a peripheral edge portion of the baffle plate on a front side, and forming a front cavity on the front side of the baffle plate, wherein the baffle plate includes at least one through hole that allows the back cavity and the front cavity to acoustically communicate with each other, and a sound wave emitted from the driver unit to the back cavity passes through the through hole, and cancels a low-frequency range sound wave of a sound wave emitted from the driver unit to the front cavity.

Note that, a space acoustically communicating with the front cavity is preferably formed between the communicating through hole in the baffle plate and the ear pad, by providing the driver unit at an attaching position in the baffle plate different height from, the peripheral portion of the baffle plate.

Further, the through hole included in the baffle plate is desirably formed in a position separated from the ear pad, and the sound wave emitted from the driver unit to the back cavity desirably passes through the through hole, and arrives at the front cavity through the space.

Further, an acoustic resistance material is desirably provided so as to cover the through hole of the baffle plate.

Further, communication holes that allow the sound wave emitted from the back side of the diaphragm to pass through to the back cavity are desirably formed on a frame of a magnetic circuit included in the driver unit.

According to such a configuration, the through hole that allows the back cavity and the front cavity to communicate with each other is formed in the position separated from the ear pad, and the front side space with which the back cavity acoustically communicates through the through hole is formed at the front side of the baffle plate. Accordingly, the sound wave having passed through the through hole from the back cavity passes through the front side space and flows into the front cavity without passing through the ear pad.

As a result, the low-frequency range sound wave having a reverse phase emitted to the back cavity can be effectively cancelled in the front side space and/or the front cavity, and the sound quality can be improved.

DESCRIPTION OF THE PREFERRED EMBODIMENTS

Figure 1:
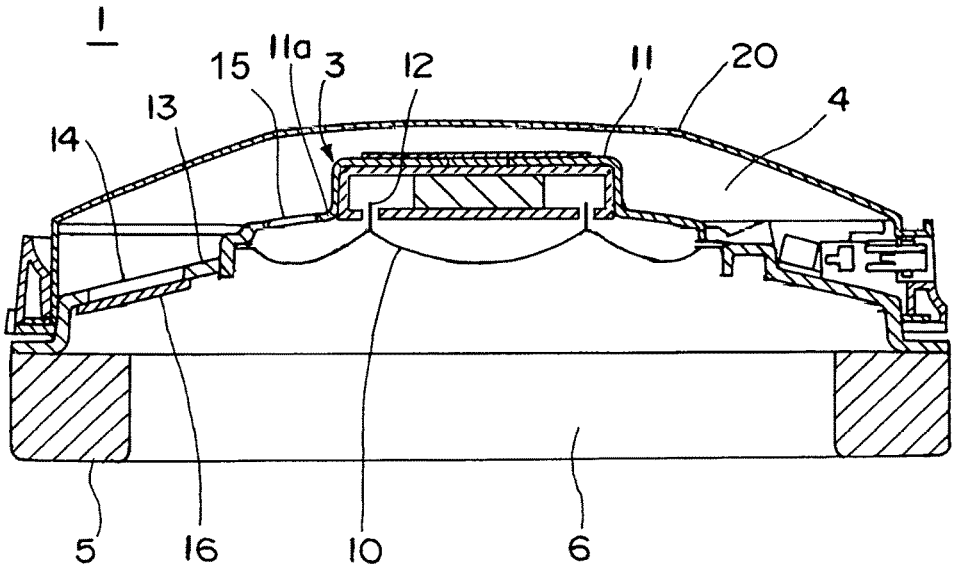
FIG. 1 is a sectional view of a headphone according to the present invention.

Hereinafter, an embodiment of the present invention will be described with reference to the drawings. FIG. 1 is a sectional view of a headphone according to the present invention. The embodiment of the present invention applied to a sealed-type dynamic headphone will be exemplarily described.

Figure 2:
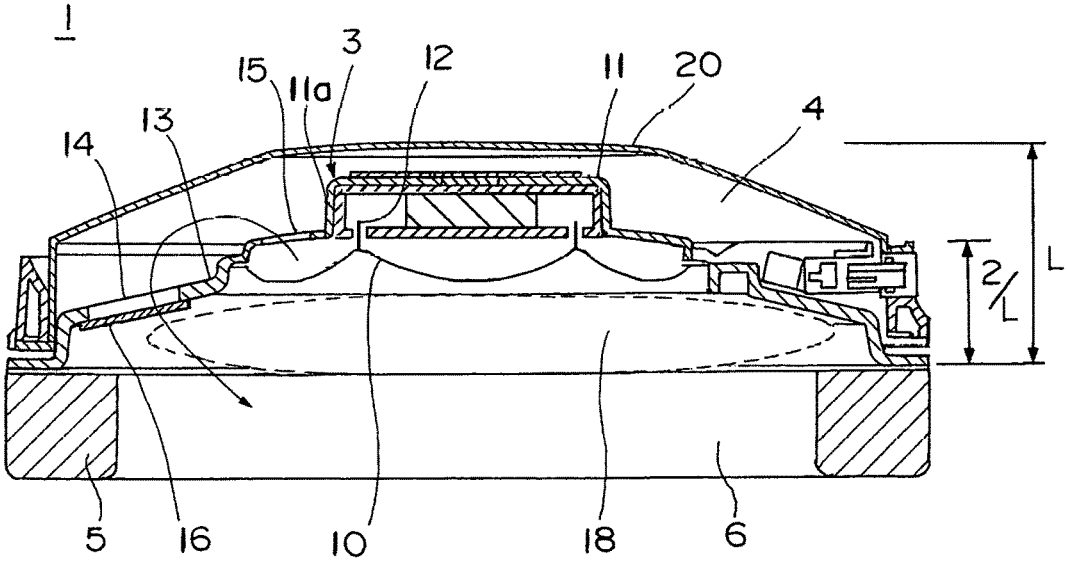
FIG. 2 is a sectional view for illustrating a flow of sound waves in the headphone of FIG. 1.
Figure 3:
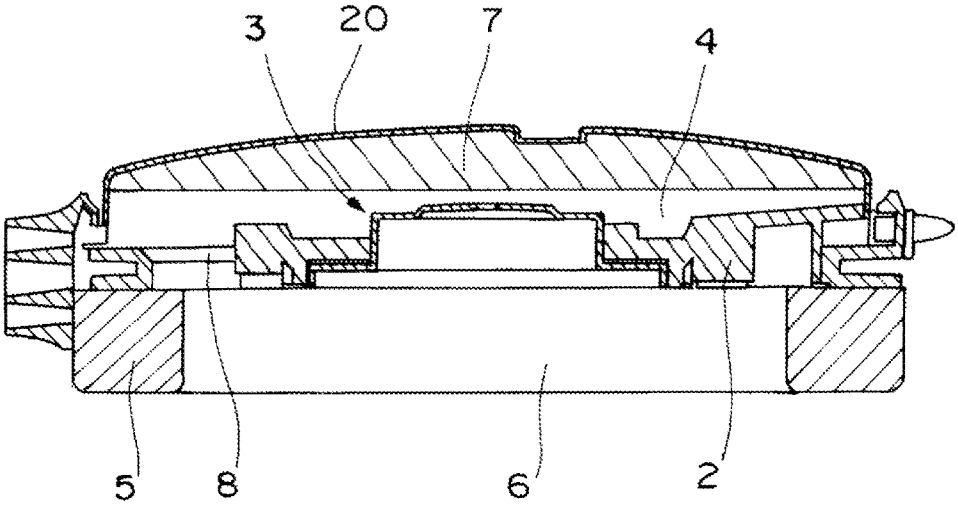
Fig. 3 Prior Art
FIG. 3 is a sectional view of a conventional headphone.

Note that, the headphone according to the present invention can use a driver unit and the like having configurations similar to those illustrated in FIG. 3. Accordingly, members in FIGS. 1 and 2 common to the configuration of FIG. 3 are denoted with the same reference signs, and their detailed description is omitted.

A dynamic headphone 1 illustrated in FIG. 1 includes a driver unit 3, which may include a diaphragm 10, a magnetic circuit portion 11, a voice coil 12 disposed in a magnetic gap formed in the magnetic circuit portion 11.

Further, in the headphone 1, a mound-shaped baffle plate 13 that holds the driver unit 3 is fit into an open end portion of a dish-shaped housing 20 with the convex side facing the housing 20. An inner surface of the housing 20 and a back side of the driver unit 3 form a back cavity 4.

Further, a ring-shaped ear pad 5 is provided at a front side (a lower side in FIG. 1) of the baffle plate 13. A space surrounded by the ear pad 5 is a front cavity 6.

The baffle plate 13 has a mound shape, and the height from its peripheral edge portion to a central portion is made larger than the height of a configuration of a conventional baffle plate, and the driver unit 3 is disposed in the central portion.

Specifically, as illustrated in FIG. 2, the baffle plate 13 and the driver unit 3 are disposed such that a distance from the peripheral edge portion of the baffle plate 13 to the position of the voice coil 12 attached to the diaphragm of the driver unit 3 may become L/2, where L is a distance from the peripheral edge portion of the baffle plate 13 to a top of the housing 20. Accordingly, a height difference from the peripheral edge portion of the baffle plate 13 to the driver unit 3 is obtained to form a front-side space 18 as illustrated in FIG. 2.

Further, at least one through hole 15 for communication that allows sound waves emitted from a back surface of the diaphragm 10 to pass to the back cavity 4 is formed in a frame 11*a* of the magnetic circuit portion 11. At least one through hole 14 is formed for communication between the back cavity 4 and the front-side space 18 with each other in the baffle plate 13. Note that the through hole 14 is covered with a damping material, that is, an acoustic resistance material 16 having high acoustic resistance, to finely adjust the sound quality in a low-frequency range. A plurality of the through holes 14 and a plurality of the through holes 15 are formed in the baffle plate 13 and in the frame 11*a*, respectively.

Thus, sound waves having a reverse phase emitted from the back side of the diaphragm 10 can pass through the through hole 15 and flow into the back cavity 4, and further pass through the through hole 14 of the baffle plate 13 and flow into the front-side space 18. Therefore, of the sound waves in a reverse phase flowing into the back cavity 4, low-frequency range sound waves without having directivity are effectively cancelled at the front-side space 18 and the front cavity 6.

According to the embodiment of the present invention, the through hole 14 for communication between the back cavity 4 and the front cavity 6 with each other is formed in the position separated from the ear pad 5, and the front-side space 18 with which the back cavity 4 acoustically communicates through the through hole 14 is formed at the front side of the baffle plate 13. Accordingly, the sound waves having passed through the through hole 14 from the back cavity 4 pass through the front-side space 18 and flow into the front cavity 6 without passing through the ear pad 5.

As a result, the low-frequency range sound waves having a reverse phase emitted to the back cavity 4 can be effectively cancelled in the front-side space 18 and/or the front cavity 6, and the sound quality can be improved.

Note that, in the embodiment, the dynamic headphone has been exemplarily described as an example of the headphone according to the present invention. However, the present invention is not limited to the described example, and can be applied to headphones having other drive systems.

Further, the distance from the peripheral edge portion of the baffle plate to the position of the voice coil of the driver unit is not limited to L/2.

Further, in the embodiment, the sealed-type headphone in which the present invention is most effective has been described. The present invention, however, is not limited thereto, and applicable to open-type headphones.

What is claimed is:

1. A headphone comprising:

a driver unit;

a baffle plate including a top portion supporting the driver unit, a peripheral edge portion located outwardly and downwardly apart from the top portion, and a middle portion extending inclinedly from the top portion to the peripheral edge portion, the baffle plate having a convex shape so that a space is formed to be surrounded by the middle portion inside the peripheral edge portion;

a housing covering back sides of the baffle plate and the driver unit to form a back cavity at the back sides of the baffle plate and the driver unit inside housing; and an ear pad attached to the peripheral edge portion of the baffle plate at a front side of the baffle plate to form a front cavity at the front side of the baffle plate inside the ear pad, the front cavity being acoustically communicated with the space surrounded by the middle portion, wherein the baffle plate includes at least one through hole through which the back cavity and the space surrounded by the middle portion are acoustically communicated with each other, the at least one through hole is arranged apart from the ear pad such that a sound wave emitted from the driver unit to the back cavity passes through the at least one through hole and arrives at the front cavity through the space surrounded by the middle portion, and a low-frequency range sound wave of the sound wave emitted from the driver unit is cancelled in the space surrounded by the middle portion and the front cavity.

2. The headphone according to claim 1, further comprising an acoustic resistance material that covers the at least one through hole of the baffle plate.

3. The headphone according to claim 1, wherein the driver unit includes a diaphragm, a magnetic circuit arranged apart from the diaphragm and having a frame, and communication holes formed in the frame of the magnetic circuit, through which the sound wave emitted from the driver unit passes to the back cavity.

4. The headphone according to claim 1, wherein the middle portion has a height between the top portion and the peripheral edge portion so that the space surrounded by the middle portion vertically extends between the driver unit and the ear pad, and the peripheral edge portion extends horizontally outwardly from a lower end of the middle portion to face the ear pad.

* * * * *